United States Patent [19]

Maehl

[11] 4,446,466

[45] May 1, 1984

[54] EXTENDIBLE TUBULAR BOOMS FOR REMOTE SENSORS

[75] Inventor: Ronald C. Maehl, Hamilton Square, N.J.

[73] Assignee: RCA Corporation, New York, N.Y.

[21] Appl. No.: 294,739

[22] Filed: Aug. 20, 1981

[51] Int. Cl.[3] ..... H01Q 1/28

[52] U.S. Cl. ..... 343/877; 343/DIG. 2

[58] Field of Search ..... 343/877, DIG. 2

[56] References Cited

U.S. PATENT DOCUMENTS

| | | | |
|---|---|---|---|
| 3,331,075 | 7/1967 | Moulton | 343/877 |
| 3,524,190 | 8/1970 | Killion et al. | 343/877 |
| 4,117,495 | 9/1978 | Hochstein | 343/877 |
| 4,265,690 | 5/1981 | Lowenhar | 343/877 |

*Primary Examiner*—Eli Lieberman

*Attorney, Agent, or Firm*—Joseph S. Tripoli; Robert L. Troike; Christopher Lyle Maginniss

[57] ABSTRACT

An extendible tubular boom includes a metallic ribbon which is prestressed to assume a rigid tubular shape when extended and which can be flattened and coiled for storage, and a plurality of conductive foil strips fixed to the ribbon which provides electrical paths between sensors located at the tip of the boom remote from the spacecraft and electronics located within the spacecraft. Remote positioning of sensors permits the measurement of parameters of the local plasma without the perturbing effect of the presence of the main body of the spacecraft. The conductive foil strips are electrically isolated from the metallic ribbon comprising the boom structure by a layer of insulating material. Both the foil strips and the insulating layer are sufficiently flexible so as to withstand the transverse and longitudinal stresses encountered as the boom is furled and unfurled.

9 Claims, 10 Drawing Figures

EXTENDIBLE TUBULAR BOOMS FOR REMOTE SENSORS

Figure 1:
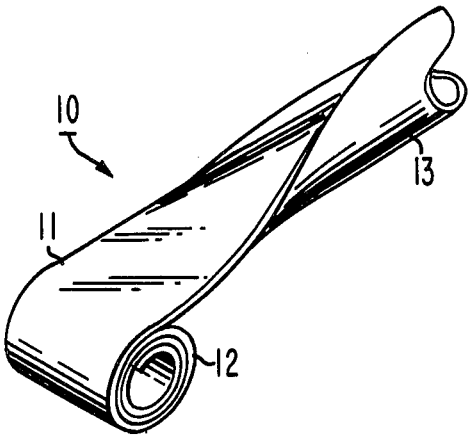
Fig. 1 PRIOR ART

This invention relates to extendible satellite booms of the type which are unfurled from a spool to assume a rigid tubular shape and, in particular, to an extendible tubular boom having a plurality of separate electrical conductors for interconnecting remote sensors with circuitry within the main body of the spacecraft.

Among the objectives to be accomplished during a satellite space mission is the collection of scientific data by the measurement of physical phenomena. Much of this collection requires sensitive equipment and it is often necessary to position at least the sensor portion away from the body of the spacecraft to minimize the effect on the measurements due to radiation generated within the spacecraft.

Satellite booms are commonly of the type which are stowed during the time the satellite is being powered into orbit, and are deployed while orbiting. Typical of this class of booms is a thin metallic ribbon which, because of transverse stresses built into it, assumes a tubular shape of high strength when extended. For storage it is flattened and coiled into a spool.

There are two basic extendible tubular boom configurations. The single-element type forms a tube with or without an overlap. The dual-element type comprises two ribbons which, when extended, form circular sections of up to 360°, one inside the other, such that the respective openings are diametrically opposed. A special configuration of dual-element type involves a first ribbon having a plurality of tabs forming its longitudinal edges and a second ribbon having a corresponding plurality of slots adjacent its longitudinal edges. The tabs of the first ribbon are engaged with the slots of the second ribbon and, when the boom is deployed, each ribbon assumes a semi-circular shape with a minimum of overlap. When the ribbons are flattened for coiling into a spool, the tabs remain engaged with the slots.

The basic concept of the extendible boom mechanism is well understood and has been used in the past to provide antennas that extend from the spacecraft main body.

In accordance with one embodiment of the present invention, an extendible boom comprises an electrically conductive ribbon which is prestressed to assume a tubular shape when extended and which can be flattened and coiled about a spool, a flexible insulating layer covering one surface of the ribbon, and a plurality of conductive foil strips extending along the length of the ribbon fixed to the flexible insulating layer.

In the drawing

Figure 2A:
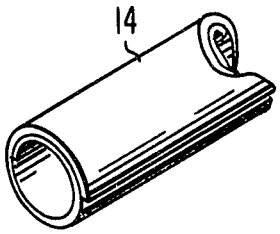
Fig. 2a PRIOR ART
Figure 2B:
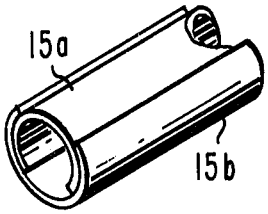
Fig. 2b PRIOR ART
Figure 2C:
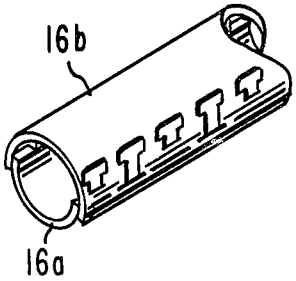
Fig. 2c PRIOR ART
Figure 3A:
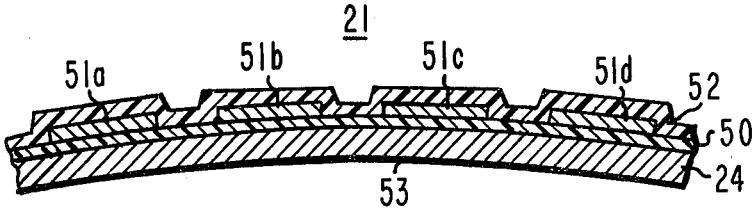
Figure 3:
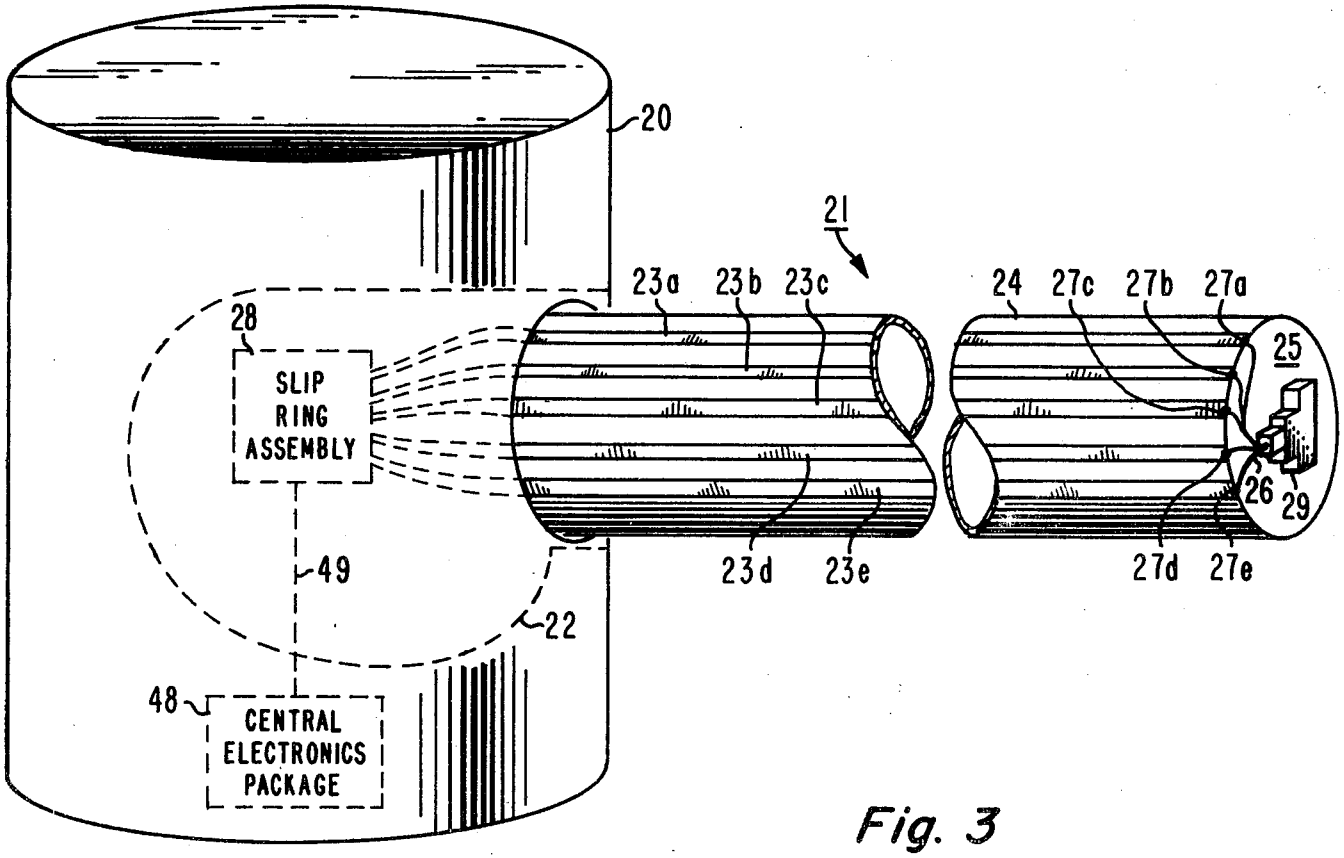
Figure 4:
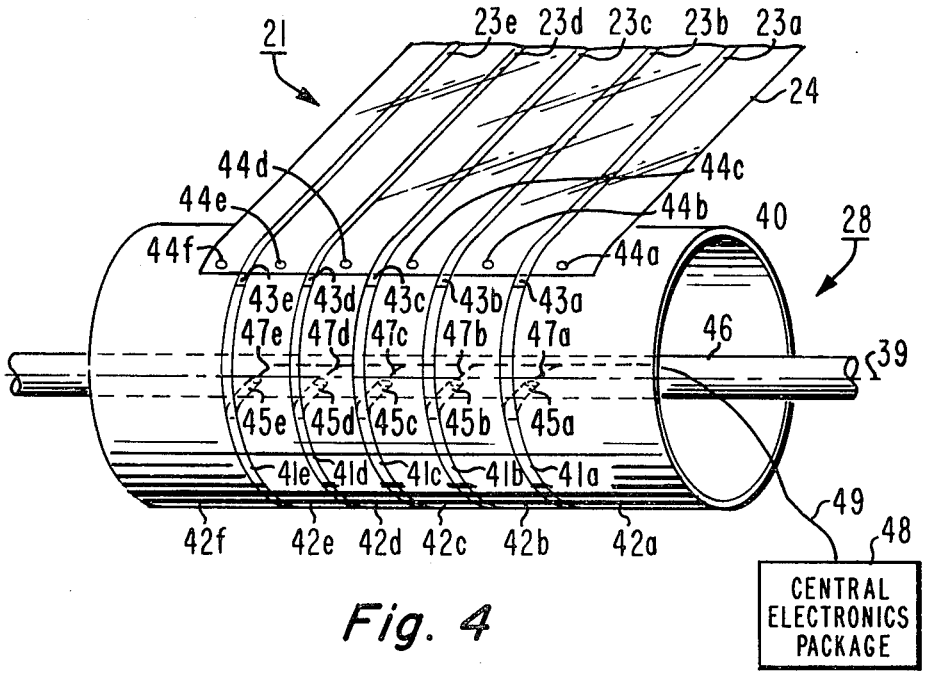
Figure 5A:
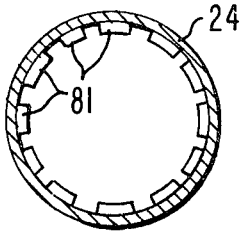
Figure 5B:
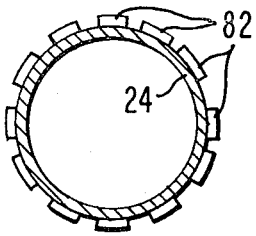
Figure 6:
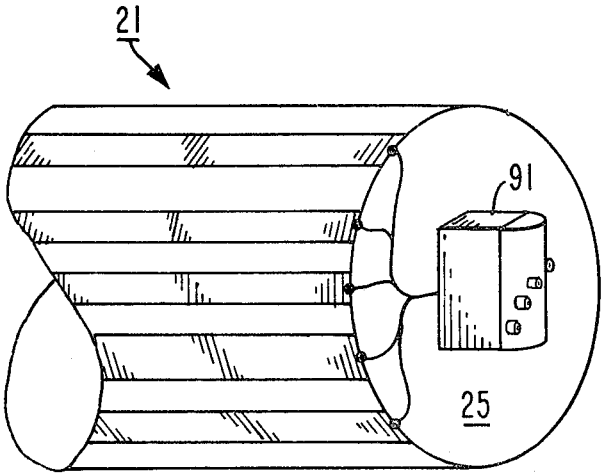

FIG. 1 is a sketch of an extendible tubular boom in a partially extended state;

FIGS. 2*a*, 2*b*, and 2*c* are sketches illustrating examples of three types of tubular extendible booms known in the art;

FIG. 3 is a sketch illustrating an extendible boom on a satellite body in accordance with one embodiment of the present invention;

FIG. 3*a* is a cross-sectional view of the conducting strips attached to the boom according to the embodiment of FIG. 3;

FIG. 4 is a sketch illustrating the preferred manner of connection between the boom and satellite utilization means;

FIGS. 5*a* and 5*b* illustrate in cross section embodiments of the present invention in which a plurality of conducting foil strips is attached to the (a) outside and (b) inside surface of the boom of FIG. 3; and FIG. 6 illustrates an embodiment of the boom of FIG. 3 having a gamma ray spectrometer as sensor.

FIG. 1 illustrates an extendible tubular boom 10 which forms part of the present invention. Boom 10 comprises an elongated ribbon 11 capable of being rolled up flat into a spool 12. Transverse stresses built into ribbon 11 cause it to assume a rigid tubular shape 13 of high strength when it is extended. This figure illustrates diagrammatically the transition between the spool 12 and the tube 13.

FIGS. 2*a*, 2*b*, and 2*c* illustrate variations of the means for maintaining rigidity of an extendible boom. Each of these variations is known in the art. FIG. 2*a* illustrates a furlable tubular boom consisting of a single ribbon 14 formed into a circular section such that the longitudinal edges overlap by a considerable arc, in this case approximately 180°. FIG. 2*b* illustrates a furlable tubular boom consisting of two ribbons 15*a* and 15*b* each formed into an open circular section such that each ribbon circumscribes an arc of approximately 270°. One ribbon is placed inside the other such that the openings are diametrically opposed. When the ribbons are flattened for retraction (not shown), they may be furled into separate spools or into a single spool. FIG. 2*c* illustrates a two-ribbon boom in which the longitudinal edges of one ribbon 16*a* are formed into tabs, and the longitudinal edges of the other ribbon 16*b* have corresponding slots into which the tabs are inserted, such that when the ribbons are unfurled and they assume their circular sections, the tab-in-slot configuration constrains the ribbons, forming a tubular boom of circular cross section. Unlike the two-ribbon boom of FIG. 2*b*, the tab-in-slot boom must furl into a single spool.

In all of the figures, as well as in the description thereof, no illustration or reference is made to the structure necessary for the rolling or spooling of the ribbon or ribbons or the supporting and dispensing thereof since it is considered that conventional drive mechanisms, guiding structures, and other structures presently known in the art will be used.

Extendible tubular boom technology has been limited to use as antennas since there exists in the prior art no way to make multiple electrical connections between the spacecraft and the instruments mounted on the extended boom. The capability to extend the size of the tubular boom to hold instruments is feasible but, by its nature, extending a cable along with the boom is not possible. This is due to the fact that the retracted boom lies flat on a reel and snaps into tubular form only on extension. This implies that there is no room for a standard cable to be coiled with the retracted boom.

This disclosure describes a system for remote positioning of electronic sensors at a predetermined position in the vicinity of a spacecraft while avoiding the effect of interference generated within the main body of the spacecraft. Referring to FIG. 3, in accordance with one embodiment of the present invention, a plurality of electrically conductive foil strips 23*a*, 23*b*, . . . 23*e*, referred to collectively as foil strips 23, are fixed to the ribbon 24 of an extendible tubular boom of the type discussed above in connection with the prior art. Boom 21 extends outwardly from dispenser 22 located within spacecraft 20. Foil strips 23 are relatively thin and narrow are flexible so as to coil for storage within dispenser 22. Within spacecraft 20, foil strips 23 are connected to slip ring assembly 28 (shown in more detail in FIG. 4), which couples the signals from foil strips 23 to the central electronics package 48 via cable 49 (also shown in FIG. 4).

Magnetometer 29, a device used for measuring the magnitude and direction of a magnetic field, is mounted on structure 25 which is attached to the tip of tubular boom 21. Structure 25 may be a cap affixed to the end of boom 21 by any of a number of well-known methods. A large number of electrical paths are required to couple magnetometer 29 with its associated electronics package 48 (shown in FIG. 4) situated within spacecraft 20. For the sake of simplicity, FIG. 3 depicts five such paths. Cable 26, comprising a multiplicity of wires in the applicant's specific embodiment, but shown as five insulated wires in FIG. 3, provides electrical paths between magnetometer 29 and foil strips 23. The wires of cable 26 are electrically coupled to the ends of foil strips 23 by, for example, solder connections 27*a*, 27*b*, . . . 27*e*. A variation would have magnetometer 29 attached to an electrically insulating structure 25, having plated conductors extending between magnetometer 29 and foil strips 23, thereby obviating the need for cable 26 and solder connections 27.

Although FIG. 3 depicts a magnetometer as the remotely-situated sensor, it should be understood that the invention applies equally to other sensing devices, such as, for example, gamma ray spectrometers, plasma wave detectors, low-energy particle detectors (ion mass spectrometers), electric field detectors, and X-ray detectors, which measure parameters of local plasma which are perturbed by the presence of the main body of the spacecraft. FIG. 6 illustrates the positioning of gamma ray spectrometer 91 mounted on structure 25 as it would be applied to boom 21 of the present invention, as embodied in FIG. 3. A gamma ray spectrometer requires a symmetrical, low-mass mounting structure, making it ideally suited to being mounted on boom 21.

Referring to FIG. 3*a* a cross-sectional view of a portion of boom 21 is shown in exaggerated scale. In the preferred embodiment, boom 21 comprises a metallic ribbon, typically made of beryllium copper or stainless steel. Although ribbons of nonmetallic substances, such as fiberglass, are known, metallic booms afford the advantages of greater strength and flexibility and of smaller weight and size, all of which are important considerations in satellite design.

A thin layer 50 of electrically insulating material is affixed to ribbon 24. Insulating layer 50 may comprise, for example, a sheet of a polyimide or a polyethylene compound such as Kapton or Mylar, respectively, both of which are trademarks of and are sold by E. I. Du Pont de Nemours & Co., Inc., Wilmington, Delaware. Layer 50 may be as thin as 0.5 mils, when using these compounds, because of their extremely low conductivity ($10^{-16}$ S/m) and their relatively high dielectric strength (7,000–7,500 V/mil). Both Kapton and Mylar are sufficiently flexible to withstand the flexures of the furling and extending of boom 21.

Foil strips 51*a*, 51*b*, 51*c* and 51*d*, referred to collectively as foil strips 51, are relatively thin, e.g., 1–2 mils, and narrow, e.g., ⅛ inch and ½ inch, yet they must provide a cross-sectional area sufficient to conduct an amount of current required for the application. Examples of typical cross-sectional dimensions of foil strips, for various current requirements, follow in a later discussion. Foil strips 51 are preferably made of a highly conductive, ductile metal such as gold, silver or copper, which is flexible so as to withstand the stresses associated with the furling and unfurling of boom 21.

Insulating layer 52 covers foil strips 51 and may be of the same type and thickness as layer 50. Insulating layer 52 prevents electrical shorting across foil strips 51 and it may also afford protection to foil strips 51 from deleterious contact with other subjects, but where that level of protection is deemed unnecessary, insulating layer 52 may not be required.

The adhesive which bonds insulating layer 50 to metallic ribbon 24, foil strips 51 to layer 50, and insulating layer 52 to foil strips 51 and layer 50 may be, for example, type SC-1337 adhesive sold by H. B. Fuller Co., Minneapolis, Minnesota, a flexible, pressure-sensitive adhesive having a synthetic rubber base, and suited for bonding polyethylene films to metal and metal foil.

The foregoing paragraphs discussed the thickness of insulating layers 50 and 52 and foil strips 51 in terms of minimum dimensions. However, maximum thickness of these components is also of concern. Ribbon 24 furls into a compact spool which will be of increased diameter when layers 50 and 52 and foil strips 51 are added. A further consideration is that the build-up of insulating layers 50 and 52 and foil strips 51 on ribbon 24 may impede the prestress built into ribbon 24, obstructing its ability to form a tubular shape. To maintain a reasonably sized spool and permit ease of formation of ribbon 24 into the tubular shape of boom 21, a maximum thickness of seven mils for the aggregate of added components including adhesive is recommended for use with extendible boom ribbons presently available.

According to FIG. 3*a*, surface 53 is the inner surface of ribbon 24 when boom 21 is extended, and insulating layers 50 and 52 and foil strips 51 are disposed on the outer surface of ribbon 24. As FIGS. 5*a* and 5*b* indicate in a simplified manner, conducting foil strips 81 may be fixed to the inner surface of ribbon 24, or conducting foil strips 52 may be fixed to the outer surface of ribbon 24. Referring again to FIG. 3*a*, conductors 51 and insulating layers 50 and 52 are subject to certain stresses when the extendible tube 21 is furled and unfurled. A first stress tends to cause either longitudinal elongation or compression of the elements attached to ribbon 24 where it is wound into a spool. A second stress tends to produce transverse elongation of the elements attached to the ribbon 24 when it assumes a circular shape, or inversely, a transverse compression of the elements when the circular ribbon 24 is flattened. Neither the longitudinal nor the transverse stress is of sufficient magnitude to be of special concern in the selection of material of conductors 51 or insulating layers 50 and 52, as will be seen in subsequent calculation.

Considering first the longitudinal stress and assuming a ribbon wall thickness of ten mils, a total thickness of seven mils for the conductors and insulating layers, and a minimum spool diameter of three inches, the maximum difference in longitudinal stress on a component affixed to ribbon 24 is proportional to the difference in radii of the inner and outer surfaces of boom 21 (including the components) which is equal to $$\frac{(1.500 + 0.010 + 0.007) - 1.500}{1.500} \times 100\% = 1.13\%$$

Considering next the transverse stress, and assuming the same dimensions for ribbon 24 and component thicknesses and further assuming a tubular diameter of two inches, the maximum difference in transverse stress affixed to ribbon 24 is proportional to the difference in radii of the inner and outer surfaces of boom 21 (including the components) which is equal to $$\frac{(1.000 + 0.010 + 0.007) - 1.000}{1.000} \times 100\% = 1.7\%$$

Because of the greater transverse stress, conductors 51 tend to be disposed in a longitudinal direction along boom 21.

Referring to FIG. 4, the flattened ribbon 24 of tubular boom 21 is illustrated in its attachment to slip ring assembly 28 within the spacecraft, according to the preferred embodiment. In the example shown, slip ring assembly 28 includes reel 40 which comprises five electrically conductive annular rings 41*a*, 41*b*, . . . , 41*e*, referred to collectively as conductors 41, spaced alternately with six electrically insulating annular rings 42*a*, 42*b*, . . . , 42*f*, referred to collectively as insulators 42, to form a tubular structure. Axis 39 of reel 40 passes through the centers of conductors 41 and insulators 42. Ribbon 24 is physically attached to reel 40 via means such as riveting at points 44*a*, 44*b*, . . . , 44*f* through ribbon 24 (not in contact with foil strips 23) into the portion of reel 40 corresponding, respectively, to insulating rings 42*a*, 42*b*, . . . , 42*f*. The attachment occurs such that the locations of foil strips 23*a*, 23*b*, . . . , 23*e* correspond, respectively, with conductors 41*a*, 41*b*, . . . , 41*e*. Tab portions 43*a*, 43*b*, . . . , 43*e* of foil strips 23, referred to collectively as tab portions 43, extending beyond ribbon 24, are electrically coupled to conductors 41*a*, 41*b*, . . . ,41*e*, respectively, by spot welding or soldering.

In the perferred embodiment, ribbon 24 is made of a metallic substance, and may therefore be electrically conductive. According to the embodiment of FIG. 4, some means may be necessary to prevent ribbon 24 from shorting across conductors 41. A likely method is to provide a thin layer of electrically insulating material either on the bottom of ribbon 24 or on the sectors of conductors 41 where ribbon 24 makes physical contact with reel 40. No insulating layer is required where foil strips 23 contact reel 40. In that case, it might also be unnecessary to connect tab portion 43 to conductors 41, if good electrical contact were ensured by the physical connection of ribbon 24 to reel 40.

As boom 21 is furled and unfurled, reel 40 rotates, necessitating some means for providing continuity of electrical paths between foil strips 23 and the central electronics package 48 within the spacecraft, regardless of the angular position of reel 40. The embodiment depicted in FIG. 4 is a form of slip ring assembly. Member 46 is fixedly mounted on the axis 39 within reel 40. Flexible electrically conductive contacts 45*a*, 45*b*, . . . ,45*e*, referred to collectively as flexible contacts 45, extend from member 46 and are urged, respectively, against conductors 41*a*, 41*b*, . . . ,41*e* on the inner surface of reel 40. Because member 46 is located on the axis 39 of reel 40, flexible contacts 45 will maintain electrical contact with conductors 41 as reel 40 turns about its axis 39. Flexible contacts 45*a*, 45*b*, . . . , 45*e* are connected, respectively, to insulated wires 47*a*, 47*b*, . . . ,47*e*, forming cable 49 which is connected to the central electronics package 48.

In order to facilitate ease of understanding, the embodiments depicted in FIGS. 3 and 4 show a relatively small number of conductive strips disposed along the boom 21. In actual practice, however, booms having diameters up to 6 inches may be expected to carry as many as 48 conductors. The table below indicates that a relatively large amount of current may be carried by a foil strip two mils thick and one-half inch wide, while foil strips one mil thick and one-eighth inch wide are sufficient for most purposes. The current ratings of the table below have been obtained from Table 3–14 of *Electronics Designer's Handbook*, edited by L. J. Giacoletto, 2d ed. (New York: McGraw-Hill, 1977), pp. 3–112 to 3–113, which refers to them as general-purpose values of operating current for copper wire.

| Foil Strip | | Equivalent | Operating |
|---|---|---|---|
| Thickness | Width | AWG | Current |
| 1 mil | ⅛" | #28 | 162 mA |
| 1 mil | ¼" | #25 | 325 mA |
| 1 mil | ½" | #22 | 651 mA |
| 2 mils | ⅛" | #25 | 325 mA |
| 2 mils | ¼" | #22 | 651 mA |
| 2 mils | ½" | #19 | 1.31 A |

Whereas the present disclosure has considered only conductive strips interconnecting sensors located at the boom tip and instruments within a spacecraft, the scope of the invention should not be construed as limited in that manner. Further application of the electrically conductive flexible foil strips, such as are obvious to one skilled in the art, must also be included. One such application is the use of electrically conductive paths to provide current to strip heating elements attached to the surface of an extended boom. By heating selected sectors along the circumference of the boom, those sectors may be made to expand, relative to unheated surfaces, causing a change in the linearity of the boom, and permitting control of the boom tip position.

What is claimed is:

1. In a spacecraft a system for measuring particles of the local plasma which are sufficiently perturbed by the presence of the main body of said spacecraft to require sensing remote from said main body, said system comprising:

an extendible boom comprising an elongated electrically conductive ribbon attached at one end to said main body of said spacecraft said ribbon being prestressed to assume a rigid tubular shape when extended, and capable of being flattened and coiled about a spool;

said ribbon having a first flexible electrically insulating layer fixed to one surface thereof, a plurality of electrically conducting foil strips fixed to said first insulating layer and disposed generally longitudinally along said ribbon, and a second electrically insulating layer fixed to and covering said plurality of conducting strips, said conducting strips and said insulating layers being of a flexible material and of a thickness relative to said ribbon and its amount of prestress to thereby permit said ribbon to coil without significant obstruction from said conducting strips and said insulating layers;

means for detecting charged particles in the local plasma, said detecting means attached to the end of said boom remote from said spacecraft body;

means coupled to said remote boom end for connecting said plurality of conducting strips to said detecting means;

utilization means within said main spacecraft body responsive to signals of said detecting means; and a slip ring assembly having a plurality of spring contacts located within said spool, said slip ring assembly coupled to the end of said boom attached to said main spacecraft body for connecting said plurality of conducting strips to said utilization means.

2. The system according to claim 1 wherein said insulating layers and said conducting strips are fixed to the outer surface of said ribbon.

3. The system according to claim 1 wherein said insulating layers and said conducting strips are fixed to the inner surface of said ribbon.

4. The system according to claim 1 wherein said detecting means includes a gamma ray spectrometer.

5. The system according to claim 1 wherein said slip ring assembly further includes a reel onto which said flattened ribbon spools, said reel comprising a plurality of annular rings of electrically conducting material of equal diameter spaced alternately with annular rings of electrically insulating material of diameters substantially equal to said electrically conducting rings, wherein said plurality of electrically conducting strips attached to said ribbon are electrically connected, respectively, to said plurality of electrically conducting rings on the outer surface of said reel, and said plurality of spring contacts of said slip ring assembly are urged, respectively, against said plurality of electrically conducting rings on the inner surface of said reel.

6. An extendible tubular boom assemby comprising:

an electrically conductive ribbon which is prestressed to assume a rigid tubular shape when extended, and which can be flattened and coiled about a spool;

a first electrically insulating layer fixed at one surface thereof to one surface of said ribbon;

a plurality of electrically conducting foil strips fixed to a second surface of said first insulating layer and disposed generally longitudinally along said ribbon, and a second electrically insulating layer fixed to and covering said plurality of conducting strips, said conducting strips and said insulating layers being of a flexible material and of a thickness relative to said ribbon and its amount of prestress to thereby permit said ribbon to coil without significant obstruction from said foil strips and said insulating layers;

means for detecting charged particles;

means coupled to a first end of said ribbon for connecting said plurality of conducting strips to said detecting means;

utilization means; and a slip ring assembly coupled to the other end of said ribbon, opposite said first end, for connecting said plurality of conducting strips to said utilization means, said slip ring assembly having a plurality of spring contacts located within said spool.

7. The boom assembly according to claim 6 wherein said insulating layers and said conducting strips are fixed to the outer surface of said ribbon.

8. The boom assembly according to claim 6 wherein said insulating layer and said conducting strips are fixed to the inner surface of said ribbon.

9. The boom assembly according to claim 6 wherein said slip ring assembly further includes a reel onto which said flattened ribbon spools, said reel comprising a plurality of annular rings of electrically conducting material of equal diameter spaced alternately with annular rings of electrically insulating material of diameters substantially equal to said electrically conducting rings, wherein said plurality of electrically conducting strips attached to said ribbon are electrically connected, respectively, to said plurality of electrically conducting rings on the outer surface of said reel, and said plurality of spring contacts of said slip ring assembly are urged, respectively, against said plurality of electrically conducting rings on the inner surface of said reel.

* * * * *